US011933150B2

(12) United States Patent
Brown et al.

(10) Patent No.: US 11,933,150 B2
(45) Date of Patent: Mar. 19, 2024

(54) ELECTRIC REMOTE OPERATED GAS LIFT MANDREL

(71) Applicant: Baker Hughes Oilfield Operations, LLC, Houston, TX (US)

(72) Inventors: Donavan Brown, Houston, TX (US); Tyler Shirk, Houston, TX (US); Stephen Bisset, Porter, TX (US)

(73) Assignee: Baker Hughes Oilfield, Houston, TX (US)

( * ) Notice: Subject to any disclaimer, the term of this patent is extended or adjusted under 35 U.S.C. 154(b) by 72 days.

(21) Appl. No.: 17/576,540

(22) Filed: Jan. 14, 2022

(65) Prior Publication Data

US 2022/0220834 A1 Jul. 14, 2022

Related U.S. Application Data

(60) Provisional application No. 63/137,723, filed on Jan. 14, 2021.

(51) Int. Cl.
*E21B 43/12* (2006.01)
*E21B 23/03* (2006.01)

(52) U.S. Cl.
CPC ..... *E21B 43/123* (2013.01); *E21B 23/03* (2013.01); *E21B 2200/02* (2020.05)

(58) Field of Classification Search
CPC ..... E21B 43/123; E21B 23/03; E21B 2200/02
See application file for complete search history.

(56) References Cited

U.S. PATENT DOCUMENTS

| | | | |
|---|---|---|---|
| 2,649,272 | A | 8/1953 | Barbato |
| 2,845,940 | A | 8/1958 | Garrett et al. |
| 2,942,671 | A | 6/1960 | Josephine |
| 3,160,113 | A | 12/1964 | Meyers |
| 3,646,953 | A | 3/1972 | Elliott et al. |
| 3,654,949 | A | 4/1972 | McMurry |

(Continued)

FOREIGN PATENT DOCUMENTS

| | | | |
|---|---|---|---|
| EP | 2666957 | A2 | 11/2013 |
| WO | 2004031529 | A2 | 4/2004 |

(Continued)

OTHER PUBLICATIONS

"MMRG Series Side Pocket Mandrels", Schlumberger, MMRG Series Side Pocket Mandrels, Sales Brochure, 2015.

(Continued)

*Primary Examiner* — Jonathan Malikasim
(74) *Attorney, Agent, or Firm* — Crowe & Dunlevy, P.C.

(57) ABSTRACT

A side pocket mandrel is configured for use within a gas lift system deployed in a well that has an annular space surrounding the gas lift system. The side pocket mandrel includes a central body that includes a central bore, a gas lift valve pocket, and a gas lift valve installed within the gas lift valve pocket. The side pocket mandrel may also include a motorized choke valve assembly to selectively cover some or all of an internal tubing port extending between the central bore and the gas lift valve pocket. The side pocket mandrel may also include an automatic closing valve assembly configured to automatically close the gas lift valve port when the gas lift valve is removed from the side pocket mandrel.

13 Claims, 5 Drawing Sheets

(56) References Cited

U.S. PATENT DOCUMENTS

| | | | | |
|---|---|---|---|---|
| 3,863,961 | A | 2/1975 | Dinning | |
| 3,874,445 | A | 4/1975 | Terral | |
| 3,888,273 | A | 6/1975 | Douglas | |
| 4,033,409 | A | 7/1977 | Hebert | |
| 4,135,576 | A | 1/1979 | Tausch | |
| 4,146,091 | A | 3/1979 | Terral | |
| 4,265,306 | A | 5/1981 | Stout | |
| 4,295,795 | A | 10/1981 | Gass et al. | |
| 4,295,796 | A | 10/1981 | Moore | |
| 4,333,527 | A | 6/1982 | Higgins et al. | |
| 4,437,487 | A | 3/1984 | Marmon | |
| 4,505,331 | A | 3/1985 | Akkerman | |
| RE32,441 | E | 6/1987 | Higgins et al. | |
| 4,685,523 | A | 8/1987 | Paschal et al. | |
| 4,759,410 | A | 7/1988 | Benker et al. | |
| 5,176,164 | A | 1/1993 | Boyle | |
| 5,535,767 | A | 7/1996 | Schnatzmeyer et al. | |
| 5,597,042 | A * | 1/1997 | Tubel | E21B 47/107 166/250.15 |
| 5,971,004 | A | 10/1999 | Pringle | |
| 6,070,608 | A | 6/2000 | Pringle | |
| 6,148,843 | A | 11/2000 | Pringle | |
| 6,206,645 | B1 | 3/2001 | Pringle | |
| 6,321,842 | B1 * | 11/2001 | Pringle | E21B 43/32 166/194 |
| 6,375,155 | B1 | 4/2002 | Janssens | |
| 6,679,332 | B2 | 1/2004 | Vinegar et al. | |
| 6,715,550 | B2 | 4/2004 | Vinegar et al. | |
| 6,722,632 | B2 | 4/2004 | Kenny et al. | |
| 7,213,607 | B2 | 5/2007 | De | |
| 7,793,727 | B2 * | 9/2010 | Gaudette | E21B 34/08 166/372 |
| 9,057,243 | B2 | 6/2015 | Hendel et al. | |
| 9,453,397 | B2 | 9/2016 | Dowling et al. | |
| 9,453,398 | B1 | 9/2016 | Zhang et al. | |
| 10,655,439 | B2 | 5/2020 | Murdoch et al. | |
| 10,677,028 | B2 | 6/2020 | Oliphant | |
| 10,787,889 | B2 | 9/2020 | Salihbegovic et al. | |
| 2001/0017157 | A1 | 8/2001 | Pringle | |
| 2002/0020533 | A1 | 2/2002 | Tubel | |
| 2007/0181312 | A1 * | 8/2007 | Kritzler | E21B 43/123 166/321 |
| 2007/0227739 | A1 | 10/2007 | Becker et al. | |
| 2013/0146155 | A1 | 6/2013 | Gilbertson et al. | |
| 2013/0220599 | A1 | 8/2013 | Rae | |
| 2020/0011155 | A1 | 1/2020 | Stamm et al. | |
| 2020/0032592 | A1 | 1/2020 | Romer et al. | |
| 2022/0186587 | A1 * | 6/2022 | Newton | E21B 34/066 |

FOREIGN PATENT DOCUMENTS

| | | | |
|---|---|---|---|
| WO | 2014022121 | A1 | 2/2014 |
| WO | 2016049726 | A1 | 4/2016 |
| WO | 2020212726 | A1 | 10/2020 |

OTHER PUBLICATIONS

Abdalsadig, Mohamed , et al., "Gas Lift Optimization Using Smart Gas Lift Valve", Abdalsadig et al., Gas Lift Optimization Using Smart Gas Lift Valve; World Academy of Science, Engineering and Technology International Journal of Mechanical and Mechatronics Engineering, vol. 10, No. 6, 2016.

Schlumberger , "Side Pocket Mandrels—Reliable Gas Lift with Flexibility for the Future; 17-AL-291763", Jan. 1, 2017.

Schlumberger , "SO2-30R-B Dual-Check Shear Orifice Gas Lift Valve", Schlumberger; SO2-30R-B Dual-Check Shear Orifice Gas Lift Valve; 2011, Jan. 1, 2011.

Schlumberger , "WRFC-H Wireline-retrievable flow control valve for gas lift applications", Schlumberger; WRFC-H Product Brochure; 09-CO-0263; 2010, Jan. 1, 2010.

Zhiyue, Xu , et al., "Smart Gas Lift Valves Eliminate Multiple Slickline Trips in Gas Lift Operations", Zhiyue, et al., Smart Gas Lift Valves Eliminate Multiple Slickline Trips in Gas Lift Operations, Offshore Technology Conference Asia, 2014.

ISA/US; Search Report and Written Opinion for PCT/US22/12534 dated May 16, 2022.

* cited by examiner

ELECTRIC REMOTE OPERATED GAS LIFT MANDREL

RELATED APPLICATIONS

This application claims the benefit of U.S. Provisional Patent Application Ser. No. 63/137,723 filed Jan. 14, 2021 entitled, "Electric Remote Operated Gas Lift Mandrel," the disclosure of which is incorporated by reference as if set forth in its entirety herein.

FIELD OF THE INVENTION

This invention relates generally to the field of oil and gas production, and more particularly to a gas lift system that incorporates an improved gas lift module.

BACKGROUND

Gas lift is a technique in which pressurized gaseous fluids are used to reduce the density of the produced fluids to allow the formation pressure to push the less dense mixture to the surface. In annulus-to-tubing systems, pressurized gases are injected from the surface into the annulus, where the pressurized gases enter the tubing string through a series of gas lift valves. Alternatively, in tubing-to-annulus systems, pressurized gases are injected into the tubing string and discharged into the annulus, where the gases help to produce fluids out of the annulus.

The gas lift valves can be configured to automatically open when the pressure gradient between the annulus and the production tubing exceeds the closing force holding each gas lift valve in a closed position. In most installations, each of the gas lift mandrels within the gas lift system is deployed above a packer or other zone isolation device to ensure that liquids and wellbore fluids do not interfere with the operation of the gas lift valve. Increasing the pressure in the annular space above the packer will force the gas lift valves to open at a threshold pressure, thereby injecting pressured gases into the production tubing or the annulus.

To permit the unimpeded production of wellbore fluids through the production tubing, the gas lift valves are housed within "side pocket mandrels" that include a valve pocket that is laterally offset from the production tubing. Because the gas lift valves are contained in these laterally offset valve pockets, tools can be deployed and retrieved through the open primary passage of the side pocket mandrel. The predetermined position of the gas lift valves within the production tubing string controls the entry points for gas into the production string.

A common problem in gas lift completions is the management of interventions required to accommodate unforeseen well operations. For example, while setting packers and testing tubing by increasing the pressure within the annulus, "dummy" valves are typically installed within the side pocket mandrels to prevent flow of completion fluids from the annulus into the production tubing, or from the production tubing into the annulus. Once the packers have been set, the dummy valves are replaced with types of gas lift valves that permit flow into the production string from the annulus.

As another example, when it becomes necessary to unload the well, the gas lift valves must be closed as the fluid level in the well drops to prevent the gas within the annulus from escaping through an open gas lift valve. This requires operators to plan the unloading sequence and valve parameters for a specific well given a set of assumed production parameters within the well. Because the operation of gas lift valves cannot be easily adjusted once the gas lift valves have been installed, typical gas lift systems cannot be easily adapted to changing production parameters within the well. There is, therefore, a need for an improved gas lift system that overcomes these and other deficiencies in the prior art.

SUMMARY OF THE INVENTION

In one aspect, embodiments of the present disclosure are directed to a side pocket mandrel for use within a gas lift system deployed in a well that has an annular space surrounding the gas lift system. The side pocket mandrel includes a central body that includes a central bore, a gas lift valve pocket, a gas lift valve installed within the gas lift valve pocket, and a motorized choke valve assembly. The gas lift valve pocket is laterally offset from the central body and the gas lift valve pocket includes a gas lift valve port that communicates fluid from the annular space to the gas lift valve pocket. The motorized choke valve assembly includes an internal tubing port that extends from the central bore to the gas lift valve pocket, a valve member configured to selectively cover some or all of the internal tubing port, and an actuator configured to drive the valve member.

In another aspect, embodiments of the present disclosure are directed to a side pocket mandrel for use within a gas lift system deployed in a well that has an annular space surrounding the gas lift system. In these embodiments, the side pocket mandrel includes a central body that includes a central bore, a gas lift valve pocket that is laterally offset from the central body, an internal tubing port that extends from the central bore to the gas lift valve pocket, an automatic closing valve assembly, and a gas lift valve. The gas lift valve pocket includes a gas lift valve port that communicates fluid from the annular space to the gas lift valve pocket. The automatic closing valve assembly includes a floating piston configured to move between a retracted position that permits flow through the gas lift valve port and a deployed position that prevents flow through the gas lift valve port, and a spring configured to apply a force to urge the floating piston into the deployed position. The gas lift valve forces the floating piston into the retracted position when the gas lift valve is installed within the gas lift valve pocket.

In yet another aspect, embodiments of the present disclosure are directed to a method of operating a gas lift system deployed in a well that has an annular space surrounding the gas lift system, where the gas lift system includes a gas lift module with a central body and a side pocket mandrel that includes a gas lift valve that controls the movement of fluids either: (i) from the annular space into the gas lift valve pocket through a gas lift valve port; or (ii) from the production tubing into the annular space through the gas lift valve port. The method includes the steps of blocking an internal tubing port that extends between a central bore in the central body and the gas lift valve pocket, increasing the pressure in the annulus or production tubing, unblocking the internal tubing port to create a pressure differential across the gas lift valve that forces the gas lift valve into an open position, and permitting pressurized gas to pass through the gas lift valve port and the internal tubing port.

In yet another aspect, embodiments of the present disclosure are directed to a method of operating a gas lift system deployed in a well that has an annular space surrounding the gas lift system, where the gas lift system includes a gas lift module with a central body and a side pocket mandrel that includes a gas lift valve that controls the movement of fluids from the annular space into the gas lift valve pocket through a gas lift valve port. In these embodiments, the method includes the steps of providing an automatic closing valve assembly within the side pocket mandrel, removing the gas lift valve from the gas live valve pocket, and deploying the automatic closing valve assembly to close the gas lift valve port.

WRITTEN DESCRIPTION

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. "Upstream" and "downstream" can be used as positional references based on the movement of a stream of fluids from an upstream position in the wellbore to a downstream position on the surface. Although embodiments of the present invention may be disclosed in connection with a conventional well that is substantially vertically oriented, it will be appreciated that embodiments may also find utility in horizontal, deviated or unconventional wells.

Figure 1:
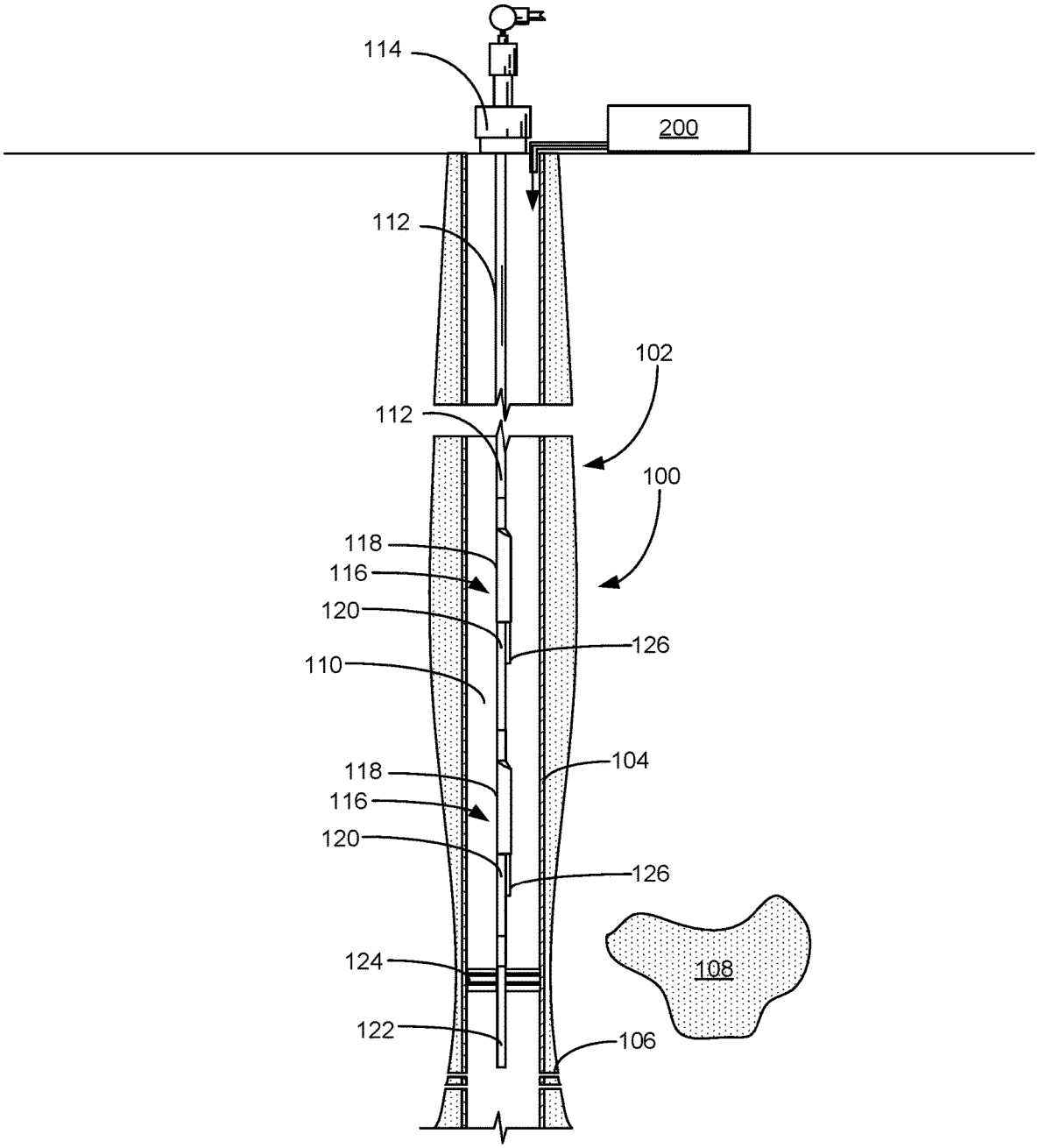
FIG. 1 is a side view of a gas lift system deployed in a conventional well.
Figure 2:
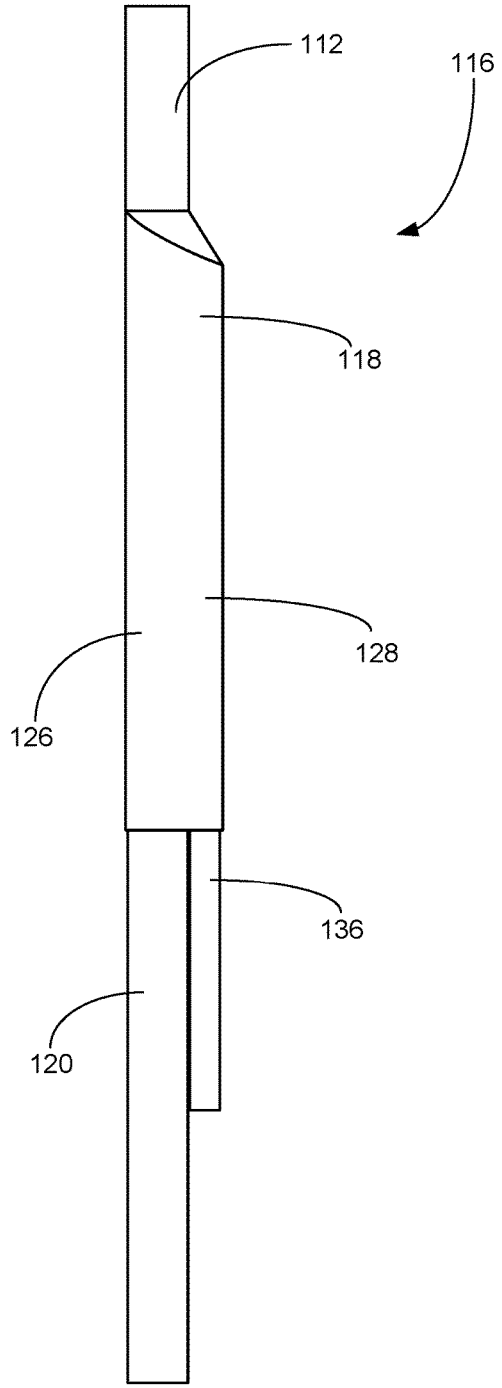
FIG. 2 is a side view of a side pocket mandrel constructed in accordance with an embodiment of the invention.
Figure 3:
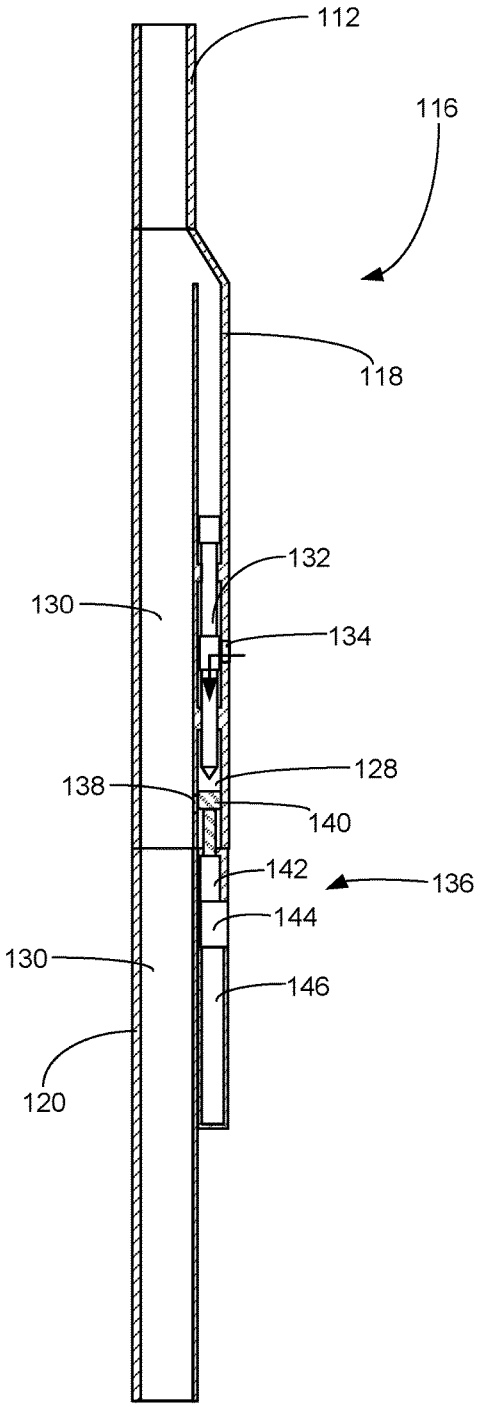
FIG. 3 is a side cross-sectional view of the side pocket mandrel, gas lift valve and electric choke in a closed position.

Turning to FIG. 1, shown therein is a gas lift system 100 disposed in a well 102. The well 102 includes a casing 104 and a series of perforations 106 that admit wellbore fluids from a producing geologic formation 108 through the casing 104 into the well 102. An annular space 110 is formed between the gas lift system 100 and the casing 104. The gas lift system 100 is connected to production tubing 112 that conveys produced wellbore fluids from the formation 108, through the gas lift system 100, to a wellhead 114 on the surface.

The gas lift system 100 includes one or more gas lift modules 116. The gas lift modules 116 each include a side pocket mandrel 118, which may be connected to a pup joint 120. An inlet pipe 122 extends through one or more packers 124 into a lower zone of the well 102 closer to the perforations 106. In this way, produced fluids are carried through the inlet pipe 122 into the lowermost (upstream) gas lift module 116. The produced fluids are carried through the gas lift system 100 and the production tubing 112, which conveys the produced fluids through the wellhead 114 to surface-based storage or processing facilities.

In accordance with well-established gas lift principles, pressurized fluids or gases are injected from a gas supply 200 on the surface into the annular space 110 surrounding the gas lift system 100. When the pressure gradient between the annular space 110 and the interior of the production tubing 112 exceeds a threshold value, the gas lift modules 116 admit the pressurized gases into the production tubing 112 through the side pocket mandrel 118. The pressurized gases combine with the produced fluids in the gas lift modules 116 to reduce the overall density of the fluid, which facilitates the recovery of the produced fluids from the well 102. The gas lift system 100 may find utility in recovering liquid and multiphase hydrocarbons, as well as in unloading water-based fluids from the well 102.

Turning to FIGS. 2-5, shown therein are various depictions of the gas lift module 116. As best illustrated in the cross-sectional views in FIGS. 3-5, the side pocket mandrel 118 includes a central body 126 and a gas lift valve pocket 128 within the side pocket mandrel 118. The central body 126 includes a central bore 130. The gas lift valve pocket 128 laterally offset and separated from the central bore 130. The side pocket mandrel 118 includes a gas lift valve 132 within the gas lift valve pocket 128. The gas lift valve 132 controls the passage of fluids from the annulus through a gas lift valve port 134 in response to pressure in the annulus 110 that exceeds the threshold opening pressure for the gas lift valve 132. For tubing-to-annulus systems, the gas lift valve 132 controls the passage of fluids from the production tubing 112 to the annular space 110.

When the gas lift valve 132 opens, fluid from the annulus 110 is admitted through the gas lift valve port 134 into the side pocket mandrel 118. In typical side pocket mandrels, the pressurized fluid is directed from the gas lift valve pocket 128 into the central bore 130, where it joins fluids produced from the perforations 106. Unlike prior art gas lift modules, the gas lift module 116 includes a motorized choke valve assembly 136 that is connected to the gas lift valve pocket 128. The motorized choke valve assembly 136 includes an internal tubing port 138 extending between the gas lift valve pocket 128 and the central bore 130, a valve member 140, an actuator 142, a communications module 144, and a power source 146.

Figure 4:
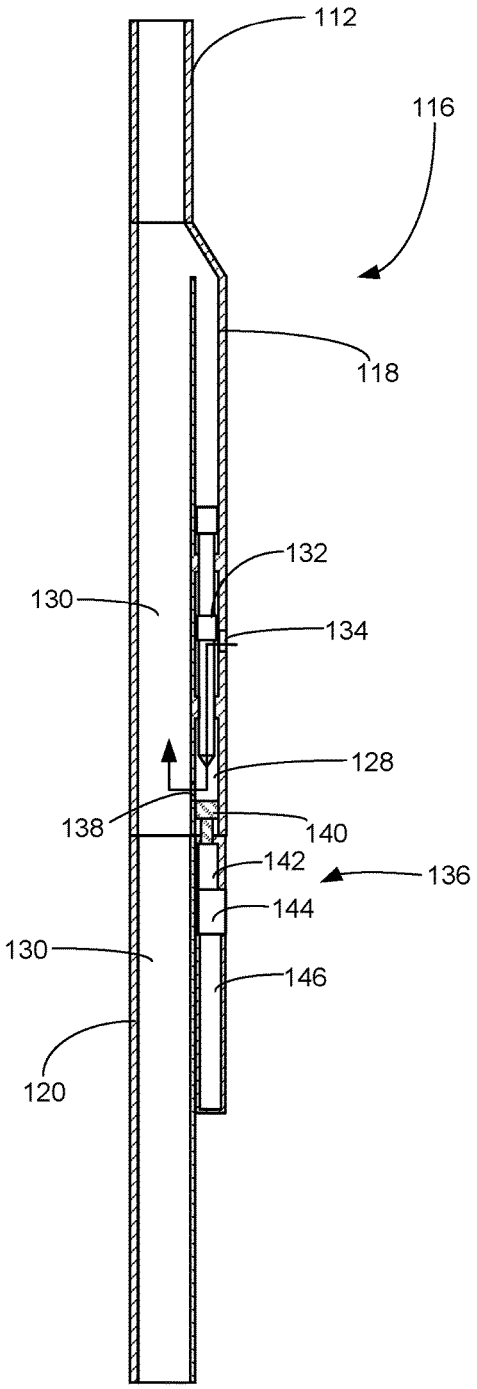
FIG. 4 is a side cross-sectional view of a first embodiment of the side pocket mandrel, gas lift valve and electric choke in an open position.
Figure 5:
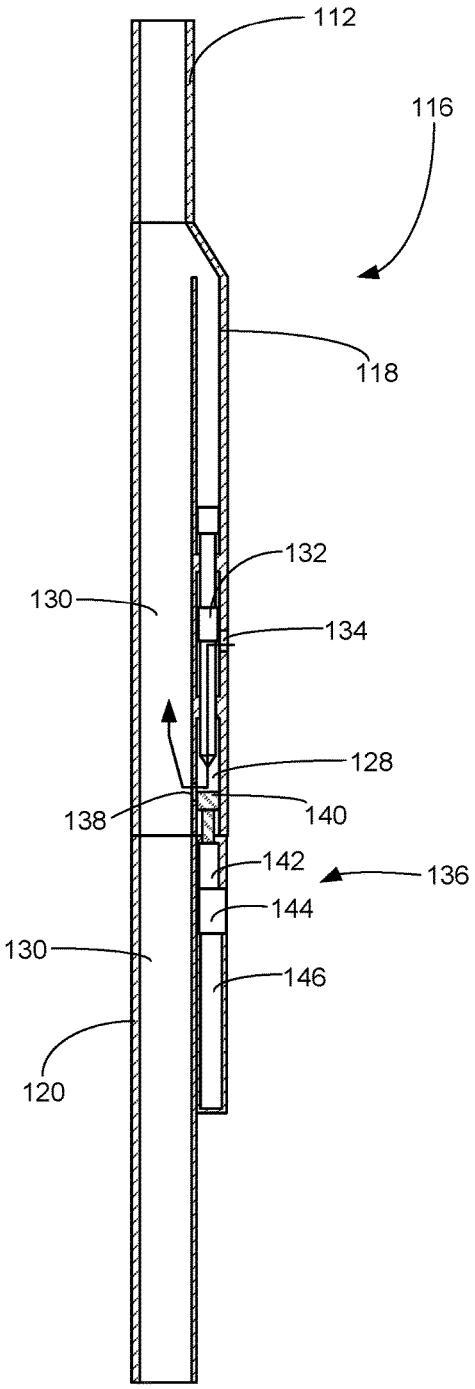
FIG. 5 is a side cross-sectional view of the side pocket mandrel, gas lift valve and electric choke of FIG. 4 in a partially open position.

In exemplary embodiments, the actuator 142 is an electric motor that controllably deploys or retracts the valve member 140 relative the internal tubing port 138 to place the motorized choke valve assembly 136 in a closed position (FIG. 3), an open position (FIG. 4), or a partially opened position (FIG. 5). The actuator 142 can drive the valve member 140 through a solenoid mechanism, a rotating mechanism in which the valve member 140 includes a threaded shaft, or any other linear actuating mechanism that permits the valve member 140 to be precisely positioned with respect to the internal tubing port 138. It will be appreciated that the valve member 140 can be constructed as a simple piston that is sized and configured to block the internal tubing port 138, or as an element that includes internal passages that only permit flow through the internal tubing port 138 when the passages are aligned with the internal tubing port 138 through, for example, axial or rotational alignment.

The actuator 142 operates in response to a command signal issued by the communications module 144. The communications module 144 can be configured to receive control signals from the surface or other downhole equipment using standard downhole communication protocols and modalities, including wireless RF, acoustic (pressure pulse) and wired. The communications module 144 is configured to receive a control signal, process the control signal, and output a command signal to the actuator 142 in response to the control signal. In exemplary embodiments, the gas lift system 100 includes a plurality of gas lift modules 116, which each include a motorized choke valve assembly 136 that can be independently controlled apart from the other motorized choke valve assemblies 136 within the gas lift system 100. This permits the operator to selectively place one or more of the plurality of gas lift modules 116 in an open state while keeping the remaining gas lift modules 116 in a closed state.

The communications module 144 and actuator 142 are provided with power from the power source 146. In exemplary embodiments, the power source 146 is a battery that is sufficiently charged before the gas lift module 116 is installed to carry out the planned operations. In other embodiments, the power source 146 includes a battery that can be remotely charged from the surface or through other wellbore equipment. Although exemplary embodiments of the motorized choke valve assembly 136 include an electric motor and electric battery, it will be appreciated that in other embodiments the actuator 142 and power source 146 are based on hydraulic, pneumatic, or a combination of hydraulic, pneumatic and electric systems.

In an exemplary method of operation, the motorized choke valve assembly 136 is moved into a closed position by sending a signal to the communications module 144 to close the internal tubing port 138 with the valve member 140. Once the internal tubing port 138 has been closed by the valve member 140, gases from the annular space 110 cannot pass through the internal tubing port 138 to the central bore 130. Once the trapped pressure within gas lift valve pocket 128 has equalized with the pressure in the annular space 110, the gas lift valve 132 may close. For example, while setting the packer 124, it may be desirable to close the motorized choke valve assemblies 136 in all of the gas lift modules 116 so that maximum fluid pressure can be applied to the packer 124 through the annular space 110.

When it becomes desirable to allow fluids from the annular space 110 to enter the production tubing 112 through the gas lift module 116, the motorized choke valve assembly 136 can be placed into an open state by sending a signal to the communications module 144 to fully or partially retract the valve member 140 from the internal tubing port 138. Once the gas lift valve 132 has been opened by pressure within the annular space 110, the fluids are then permitted to pass through the gas lift valve pocket 128 into the central bore 130 through the internal tubing port 138. It will be appreciated that the motorized choke valve assembly 136 can be opened before or after gases are injected into the annular space 110 to open the gas lift valve 132. Although the embodiment depicted in FIGS. 4-5 has been illustrated and described in connection with an annulus-to-tubing system, the same embodiment can also be used in connection with a tubing-to-annulus system in which pressurized gas is injected into the production tubing 112 and discharged through the gas lift module 116 into the annular space 110.

The ability to selectively enable and disable the gas lift valve 132 with the motorized choke valve assembly 136 significantly improves the versatility of the gas lift system 100 by allowing the operator to respond to a condition in which preventing the flow of fluids between the gas lift valve pocket and the central bore is desirable. For example, while the well 102 is being unloaded of excess fluid in the annular space 110, the motorized choke valve assembly 136 can be activated to selectively disable the gas lift valve 132 in a gas lift module 116 that is no longer under the liquid level in the annular space 110. Without the ability to selectively disable the gas lift valve 132 within the gas lift module 116, pressure within the annular space 110 would tend to escape through the "dry" gas lift module 116, thereby decreasing the efficiency of the unloading operation. In this way, the motorized choke valve assembly 136 enables the operator to only open those gas lift modules 116 that are useful in unloading the well 102.

Thus, the remotely actuated motorized choke valve assembly 136 provides the operator with more precise control of individual gas lift modules 116 within the gas lift system 100 without the need for complicated pre-installation configurations of multiple gas lift valves 132 within the gas lift system 100. Additionally, this provides the operator with the ability to respond to unforeseen conditions that develop in the well 102 after the gas lift system 100 has been installed, without the need to remove the gas lift system 100 or carry out disruptive and expensive interventions while the gas lift system 100 is in the well 102. Instead of removing the gas lift valve 132 to change the size or type of the gas lift valve 132 to be installed in the gas lift valve pocket 128, the motorized choke valve assembly 136 can be activated to increase or reduce flow through the side pocket mandrel 118.

Figure 6:
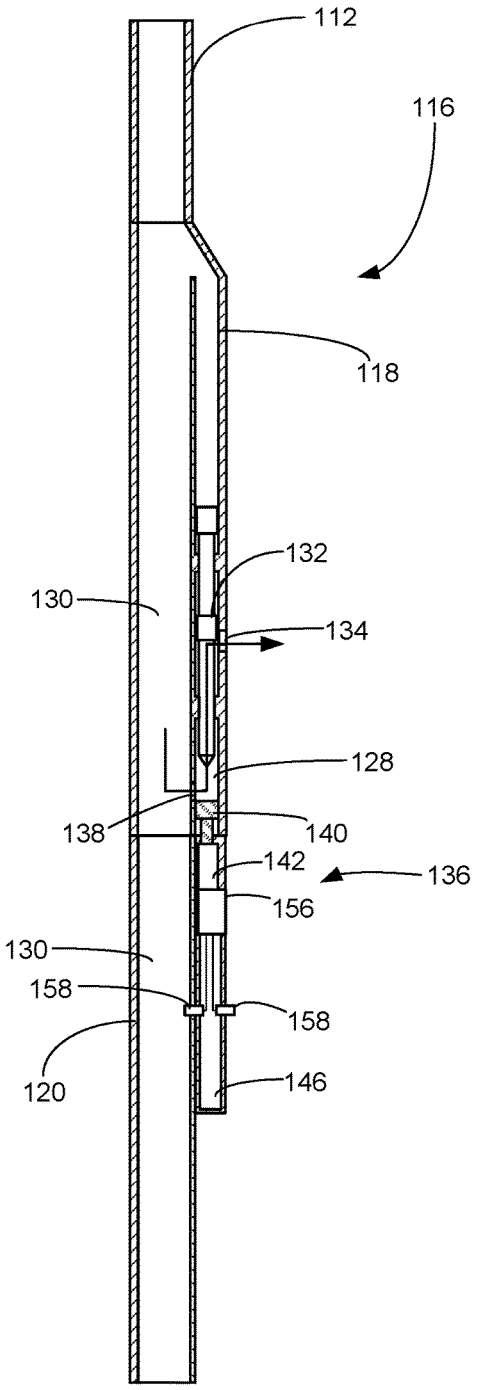
FIG. 6 is a side cross-sectional view of a second embodiment of the side pocket mandrel, gas lift valve and electric choke in an open position.
Figure 7:
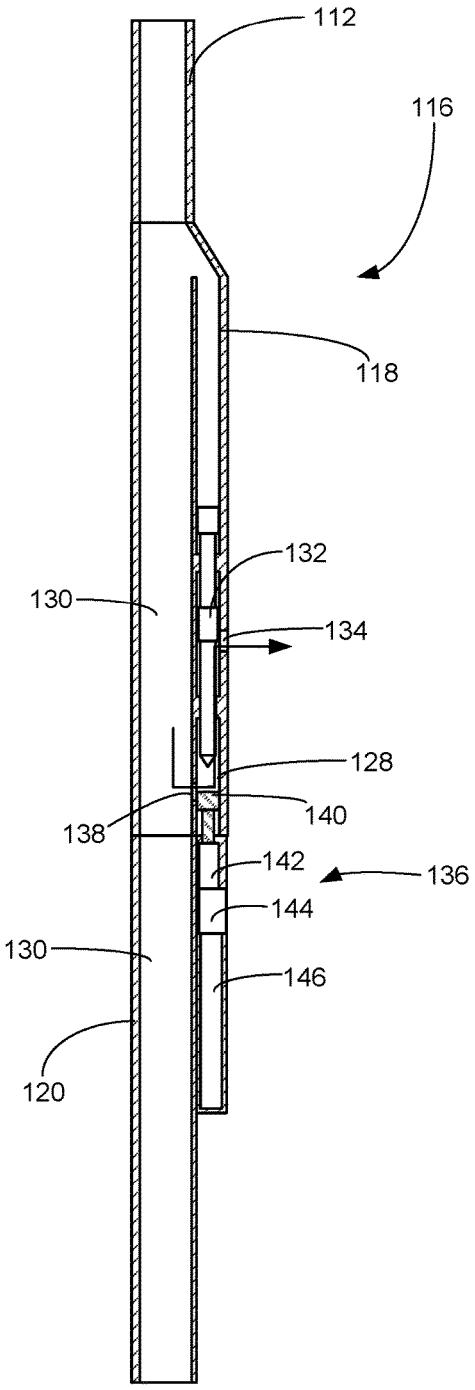
FIG. 7 is a side cross-sectional view of the side pocket mandrel, gas lift valve and electric choke of FIG. 6 in a partially open position.

In a second embodiment depicted in FIGS. 5-6, the motorized choke valve assembly 136 includes an onboard computer 156 and one or more sensors 158. The onboard computer can be powered by the power source 146 and configured to automatically control the operation of the motorized choke valve assembly 136 in response to measurements made by the sensors 158. The sensors 158 can be configured to measure conditions at or near the gas lift module 116. In some embodiments, the sensors 158 are configured to determine the pressure differential between the production tubing 112 and the annular space 110 and output representative signals to the onboard computer 156. The onboard computer 156 is programmed to process the signals generated by the sensors 158 and apply a responsive control scheme for the motorized choke valve assembly 136. It will be noted that FIGS. 6 and 7 depict a tubing-to-annulus system in which pressurized gas is injected into the production tubing 112 and discharged through the gas lift module 116 into the annular space 110. The embodiment depicted in FIGS. 6-7 can also be used with annulus-to-tubing systems (as depicted in FIGS. 4-5).

Figure 8:
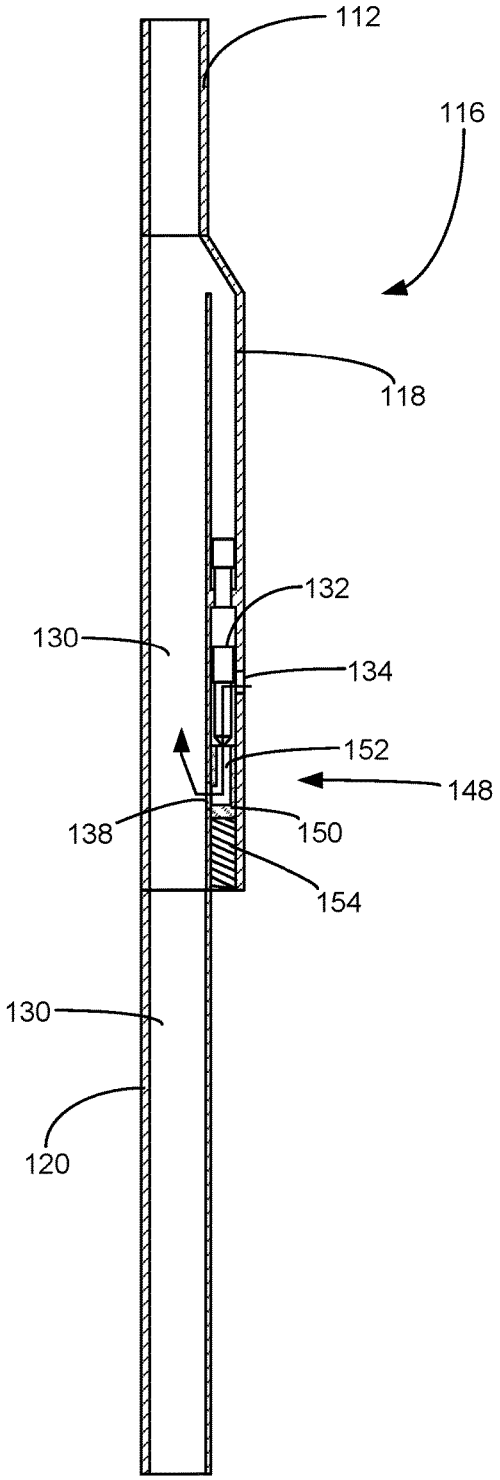
FIG. 8 provides a cross-sectional view of an embodiment of the gas lift module that includes an automatic closing assembly in a retracted position.
Figure 9:
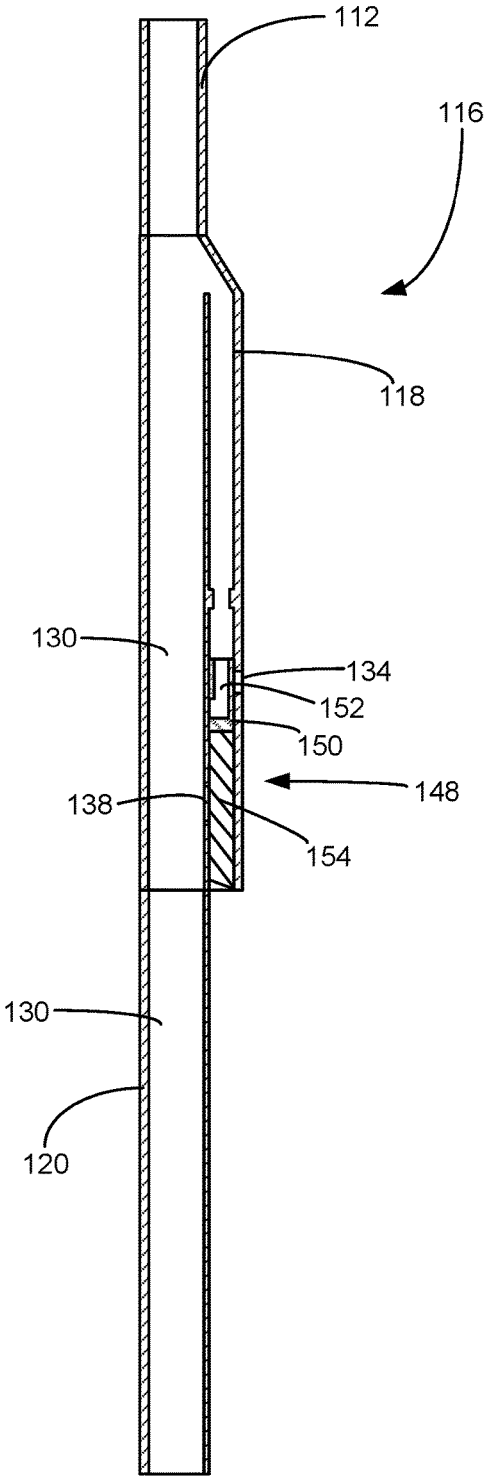
FIG. 9 provides a cross-sectional view of an embodiment of the gas lift module that includes an automatic closing assembly in a deployed position.

Turning to FIGS. 8 and 9, shown therein are cross-sectional views of the side pocket mandrel 118 constructed in accordance with an additional embodiment of the present invention. As depicted in FIGS. 8 and 9, the side pocket mandrel 118 includes an automatic closing valve assembly 148 that prevents flow through the side pocket mandrel 118 when then the gas lift valve 132 is removed from the side pocket mandrel 118. The automatic closing valve assembly 148 includes a floating piston 150 that includes a through-passage 152. The automatic closing valve assembly 148 includes a spring 154 that presses the floating piston 150 against the gas lift valve 132.

The automatic closing valve assembly 148 is installed within the gas lift valve pocket 128 prior to deploying the gas lift module 116 into the well 102. When the gas lift valve 132 is installed within the gas lift valve pocket 128 (as depicted in FIG. 8), the gas lift valve 132 pushes the floating piston 150 into a retracted position against the force applied by the spring 154. When the gas lift valve 132 opens in response to a sufficient pressure differential, fluid from the annular space 110 is allowed to travel through the gas lift valve port 134, through the gas lift valve 132, through the through-passage 152 of the floating piston 150, and into the central bore 130 of the gas lift module 116 through the internal tubing port 138. The latch mechanism that holds the gas lift valve 132 within the gas lift valve pocket 128 prevents the gas lift valve 132 from being pushed out of the gas lift valve pocket 128 by the spring 154.

When the gas lift valve 132 is removed, the spring 154 forces the floating piston 150 into a deployed position depicted in FIG. 9. In the deployed position, the floating piston 150 blocks the gas lift valve port 134 to prevent flow of gases or fluids from the annular space 110 into the gas lift module 116. At the same time, the automatic closing valve assembly 148 prevents the unintended escape of production fluids passing through the gas lift module 116 by closing the external gas lift valve ports 134 that would otherwise place the interior of the side pocket mandrel 118 to the annular space 110. Although the embodiment depicted in FIGS. 8-9 has been illustrated and described in connection with an annulus-to-tubing system, the same embodiment can also be used in connection with a tubing-to-annulus system in which pressurized gas is injected into the production tubing 112 and discharged through the gas lift module 116 into the annular space 110.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A side pocket mandrel for use within a gas lift system deployed in a well that has an annular space surrounding the gas lift system, the side pocket mandrel comprising:
- a central body that includes a central bore;
- a gas lift valve pocket that is laterally offset from the central body, wherein the gas lift valve pocket includes a gas lift valve port that communicates fluid between the annular space and the gas lift valve pocket;
- a gas lift valve installed within the gas lift valve pocket; and
- a motorized choke valve assembly, wherein the motorized choke valve assembly comprises:
  - an internal tubing port that extends from the central bore to the gas lift valve pocket;
  - a valve member configured to selectively cover some or all of the internal tubing port; and
  - an actuator configured to deploy and retract the valve member.

2. The side pocket mandrel of claim 1, wherein the motorized choke valve assembly further comprises a power source.

3. The side pocket mandrel of claim 2, wherein the actuator is an electric motor.

4. The side pocket mandrel of claim 3, wherein the actuator is a solenoid.

5. The side pocket mandrel of claim 3, wherein the power source is a battery.

6. The side pocket mandrel of claim 1, wherein the motorized choke valve assembly further comprises a communications module configured to receive a control signal, process the control signal, and output a command signal to the actuator.

7. The side pocket mandrel of claim 1, wherein the motorized choke valve assembly further comprises:
- one or more sensors configured to measure a condition near the side pocket mandrel and output a signal representative of the measurement; and
- an onboard computer configured to receive the signal output from the one or more sensors and automatically apply a control scheme to the motorized choke valve assembly based on the signal output from the one or more sensors.

8. A side pocket mandrel for use within a gas lift system deployed in a well that has an annular space surrounding the gas lift system, the side pocket mandrel comprising:
- a central body that includes a central bore;
- a gas lift valve pocket that is laterally offset from the central body, wherein the gas lift valve pocket includes a gas lift valve port that communicates fluid between the annular space and the gas lift valve pocket;
- an internal tubing port that extends from the central bore to the gas lift valve pocket;
- an automatic closing valve assembly, wherein the automatic closing valve assembly comprises:
  - a floating piston configured to move between a retracted position that permits flow through the gas lift valve port and a deployed position that prevents flow through the gas lift valve port; and
  - a spring configured to apply a force to urge the floating piston into the deployed position; and
- a gas lift valve, wherein the gas lift valve forces the floating piston into the retracted position when the gas lift valve is installed within the gas lift valve pocket and wherein the floating piston is configured to automatically move to the deployed position when the gas lift valve is removed from the side pocket mandrel.

9. The side pocket mandrel of claim 8, wherein the floating piston comprises a through-passage that permits the passage of fluid through the floating piston when the through-passage is aligned with the internal tubing port.

10. A method of operating a gas lift system deployed in a well that has an annular space surrounding the gas lift system, wherein the gas lift system includes a gas lift module with a central body and a side pocket mandrel that includes a gas lift valve that controls the movement of fluids between the annular space and the gas lift valve pocket through a gas lift valve port, the method comprising the steps of:
- providing an automatic closing valve assembly within the side pocket mandrel;
- removing the gas lift valve from the gas lift valve pocket; and
- deploying the automatic closing valve assembly to close the gas lift valve port while the gas lift valve is removed from the gas lift valve pocket.

11. The method of claim 10, wherein the step of providing the automatic closing valve assembly further comprises providing the automatic closing valve assembly that includes a floating piston and a spring that urges the floating piston toward a deployed position.

12. The method of claim 11, wherein before the step of removing the gas lift valve, the method further comprises the step of installing the gas lift valve within the gas lift valve pocket to compress the floating piston into a retracted position.

13. The method of claim 12, wherein the step of deploying the automatic closing valve assembly comprises removing the gas lift valve from the gas lift valve pocket to permit the spring to force the floating piston into the deployed position to close the gas lift valve port.

* * * * *